US008387691B2

(12) United States Patent
Sullivan et al.

(10) Patent No.: US 8,387,691 B2
(45) Date of Patent: Mar. 5, 2013

(54) LOW PRESSURE RECOVERY PROCESS FOR ACCELERATION OF IN-SITU BITUMEN RECOVERY

(75) Inventors: Laura A. Sullivan, Calgary (CA); Caroline Heron, Calgary (CA); Harald F. Thimm, Calgary (CA)

(73) Assignee: Athabasca Oils Sands Corporation, Calgary, Alberta (CA)

( * ) Notice: Subject to any disclaimer, the term of this patent is extended or adjusted under 35 U.S.C. 154(b) by 581 days.

(21) Appl. No.: 12/253,827

(22) Filed: Oct. 17, 2008

(65) Prior Publication Data

US 2010/0096126 A1 Apr. 22, 2010

(51) Int. Cl.
*E21B 43/00* (2006.01)

(52) U.S. Cl. ..... 166/266

(58) Field of Classification Search ..... 166/266
See application file for complete search history.

(56) References Cited

U.S. PATENT DOCUMENTS

| | | | | |
|---|---|---|---|---|
| 3,771,598 | A * | 11/1973 | McBean | 166/268 |
| 4,116,275 | A * | 9/1978 | Butler et al. | 166/303 |
| 4,344,485 | A * | 8/1982 | Butler | 166/271 |
| 5,899,274 | A * | 5/1999 | Frauenfeld et al. | 166/401 |
| 6,039,121 | A * | 3/2000 | Kisman | 166/369 |
| 6,257,334 | B1 * | 7/2001 | Cyr et al. | 166/272.7 |
| 7,172,030 | B2 * | 2/2007 | Horner et al. | 166/402 |
| 7,516,789 | B2 * | 4/2009 | Chhina et al. | 166/260 |
| 2008/0017372 | A1 * | 1/2008 | Gates et al. | 166/254.1 |
| 2010/0163229 | A1 * | 7/2010 | Nenniger | 166/272.3 |

FOREIGN PATENT DOCUMENTS

| | | |
|---|---|---|
| CA | 1130201 | 8/1982 |
| CA | 2015460 | 12/1993 |
| CA | 2015459 | 8/1995 |
| CA | 2277378 | 9/2002 |
| CA | 2591498 | 6/2006 |

OTHER PUBLICATIONS

Collins, Patrcik, Geomechanical Effects on the SAGD Process, 2005 SPE/PS-CIM/CHOA—International Thermal Operations and Heavy Oil Symposium, SPE International (SPE/PS-CIM/CHOA 97905).*
Dusseault, Maurice, CHOPS: Cold Heavy Oil Production with Sand in the Canadian Heavy Oil Industry, Mar. 2002, MBDC Inc. for Alberta Department of Energy.*
Butler, R. "The Steam and Gas Push (SAGP)," Journal of Canadian Petroleum Technology (Mar. 1999), 38(3), pp. 54-61.
Butler, R. et al. "Steam and Gas Push (SAGP)—3; Recent Theoretical Developments and Laboratory Results," Journal of Canadian Petroleum Technology (Aug. 2000), 39(8), pp. 51-60.
Shin, H. and Polikar, M. "Fast-SAGD Application in the Alberta Oil Sands Areas," Journal of Canadian Petroleum Technology (Sep. 2006), 45(9), pp. 46-53.

(Continued)

*Primary Examiner* — Terry Melius
*Assistant Examiner* — Silvana Runyan
(74) *Attorney, Agent, or Firm* — Stephen M. De Klerk

(57) ABSTRACT

A method for recovery of hydrocarbons from a subterranean reservoir is described. Adjacent injector producer well pairs are operated under conditions of steam assisted gravity drainage with a lateral drainage well between them. The lateral drainage well is operated under conditions of intermittent steam injection and alternating oil, water and gas production. NCG is co-injected with steam at selected intervals and in selected quantities in order to control the steam saturation of the SAGD steam chamber and the rise of the steam chamber, and to encourage lateral fluid communication between the adjacent well pairs and the LD well to control the rise of the steam chamber.

26 Claims, 3 Drawing Sheets

OTHER PUBLICATIONS

Shin, H. and Polikar, M. "Review of Reservoir Parameters to Optimize SAGD and Fast-SAGD Operating Conditions," Journal of Canadian Petroleum Technology ( Jan. 2007), 46(1), pp. 35-41.
Thimm, H.F. "Re-Pressurization of the Gas Zone Above a SAGD Project: Is There Potential for Carbon Dioxide Sequesteration?," presented at *The Petroleum Society's Canadian International Petroleum Conference 2002*, Calgary, Alberta, Jun. 11-13, 2002, Paper 2002-236 , pp. 1-6.
Thimm, H.F. "Low Pressure SAGD Operations," Journal of Canadian Petroleum Technology (Sep. 2005), 44(9), pp. 58-61.

* cited by examiner

LOW PRESSURE RECOVERY PROCESS FOR ACCELERATION OF IN-SITU BITUMEN RECOVERY

FIELD OF THE INVENTION

The present invention relates generally to recovery processes of heavy oil or bitumen from an underground oil-bearing reservoir by thermal methods. More particularly, the present invention relates to in-situ recovery of bitumen from an underground oil-bearing reservoir where the initial reservoir pressure is lower than what would be expected via hydrostatic pressure gradient due to regional geological effects, depleted gas caps or other thief zones, or lack of overlying cap rock. More particularly, the present invention relates to recovery processes where overlying underground strata are at low pressure due to any one or more of the factors above, the most common example of which is prior gas production.

BACKGROUND OF THE INVENTION

A number of patents relate to the recovery of bitumen or heavy oil from underground reservoirs by thermal methods.

Canadian Patent No. 1,130,201 (Butler) teaches a thermal method for recovering highly viscous oil from bitumen deposit in unconsolidated sand by means of Steam Assisted Gravity Drainage (SAGD). The method consists of drilling two long horizontal wells, parallel and in the same direction, with one located several metres above the other. Steam is injected into the upper well, thermal communication is established between the two wells, and oil and water drain continuously to the lower well from where they are pumped to the surface.

Canadian Patent Nos. 2,015,459 and 2,015,460 (Kisman) teach a technique of gas injection into a thief zone in a bitumen bearing sand. This thief zone causes an unwanted degree of lateral steam migration from the vertical wells; the gas injection prevents this unwanted lateral migration by establishing a confining pressure from outside the well pattern, so that the steam cannot escape.

Canadian Patent No. 2,277,378 (Cyr and Coates) teaches a thermal process for recovery of viscous hydrocarbon that is operated in a similar manner as SAGD. A third parallel and coextensive horizontal well is provided at a suitable lateral distance from the SAGD well pair described by Butler in Canadian Patent No. 1,130,201. The purpose of the third is to practice cyclic steam stimulation in such a manner as to improve the heat distribution throughout the subterranean reservoir. In the SAGD well pair, steam will tend to rise to the top of the hydrocarbon bearing structure. By cyclic steam stimulation at the third well, steam injection is alternated with oil production to achieve a more favourable heat distribution than is possible with SAGD alone.

Canadian Patent Application No. 2,591,498 (Arthur, Gittins and Chhina) teaches an extended SAGD process with a similar well configuration to patent 2,277,378 by Cyr. The purpose is likewise to access a region of bitumen which would normally be bypassed by SAGD if operated in the manner taught by Butler. The purpose here is to access that portion of said reservoir whose hydrocarbons have not been or had not been recovered in the course of the . . . gravity controlled process. The recovery method from the third well, referred to as an infill well, is expected to be a gravity controlled process, though not necessarily limited to SAGD. Reference is made to injection of light hydrocarbons or gases to maintain pressure once steam injection is discontinued.

Large deposit of oil sands exist in Alberta, Canada and other regions where a low pressure zone or loss zone such as a "thief" zone overlies the deposit, for example natural gas in contact or fluid communication with the bitumen or heavy oil, where natural gas has been produced or is present at low pressure for other reasons. Similarly, there are large deposits in which the bitumen resources are in direct contact with overlying water zones, resulting in some cases from the previous gas production. There are also areas that are at low initial reservoir pressure for reasons that are not apparent in the immediate area, but result from regional geological features. Other reservoirs exist in Canada and elsewhere where there is no identifiable cap rock in which to contain injected fluids. In these conditions, steam losses to the thief zone could be substantial, potentially impacting the overall rate of recovery.

It is therefore desirable to provide a method or process for accelerating bitumen production in these conditions.

The present invention is direct to the above conditions and accelerates production from such reservoirs, or renders such bitumen or heavy oil volume more readily producible, without requiring remedial action, such as the re-injection of gas into the low pressure zone, which is being performed.

SUMMARY OF THE INVENTION

A method for recovery of hydrocarbons from a subterranean reservoir by operating two injector producer well pairs under conditions of steam assisted gravity drainage (SAGD) with a lateral drainage (LD) well between and substantially parallel to the two injector producer well pairs; the LD well is operated under conditions of intermittent steam injection and alternating oil, water and gas production; NCG is co-injected with steam into both the injector wells and the lateral drainage well at selected intervals, and in selected quantities in order to control the steam saturation of the SAGD steam chamber and the rise of the steam chamber, and to encourage lateral fluid communication between the adjacent well pairs and the LD well; controlling gas injection and production in order to manipulate the rise of the steam chamber to improve production of oil; operating the well pairs and the LD well under conditions of a steam chamber pressure that is initially and briefly high to establish a steam chamber, but thereafter may be reduced to as low as 200 kPa, a process of low pressure SAGD.

In the present invention, NCG is injected not to restrict horizontal movement of steam as in some of the background art, but to encourage horizontal movement of the steam. LD wells are not, primarily, placed to recover oil, but instead to assist in controlling the amount of gas in the SAGD steam chamber. Further control of the amount of gas in the SAGD steam chamber is affected by manipulation of the solubility of gas components in water, such that the components may be produced as needed to reduce the amount of gas in the steam chamber. The temperature and/or pressure is/are adjusted to provide solubility control. The process may utilize steam pressures as low as 200 kPa, whereas the lowest steam pressure thus far utilized in the field is 800 kPa, and the Alberta Energy Resources Conservation Board has previously recognized that a lower limit of 600 kPa is feasible. The invention therefore may be applicable to reservoirs with very low gas pressures, where recovery has not heretofore been attempted.

The process includes:

Controlling the steam saturation in the SAGD zone in such a manner that the vertical rise rate of the steam chamber is controlled to reduce and manage steam loss or breakthrough to low pressure zones, by means of controlled gas co-injection with steam;

Introducing a lateral drainage (LD) well to control the amount of gas present in the steam chamber and to encourage horizontal rather than vertical migration of the steam, thus taking advantage of the delayed vertical growth and/or breakthrough of steam to the low pressure zone or loss zone in order to obtain a sweep of the bitumen or heavy oil;

Utilizing means to manipulate the solubility of steam zone gases in water, thus controlling the amount of gas in the steam chamber in concert with gas production from the LD well; and Operating at low steam pressures.

Production of bitumen or heavy oil is thus possible in an accelerated fashion, and in reservoir conditions where the reservoir pressure is low.

It is an object of the present invention to obviate or mitigate at least one disadvantage of previous methods and processes for bitumen recovery.

In a first aspect, the present invention provides a method of producing hydrocarbons from a subterranean reservoir at least partially overlain by a low pressure zone or loss zone including providing a SAGD well pair, including an injection well and a production well within the reservoir, providing a lateral drainage (LD) well, laterally offset from the SAGD well pair within the reservoir, initiating operation of the SAGD well pair and the LD well to create or promote a common steam chamber within the reservoir and establish fluid communication among the injection well, production well, and the LD well, injecting steam into the steam chamber and withdrawing produced fluids from the steam chamber to grow the steam chamber vertically until a selected condition is met, and selectively injecting non-condensable gas (NCG) into the steam chamber at a selected rate and reducing the pressure of the steam chamber to create or expand a gas zone within the reservoir and create or promote a NCG buffer zone between the steam chamber and the low pressure zone or loss zone.

In one embodiment selectively injecting NCG into the steam chamber at a low rate and reducing the pressure of the steam chamber is substantially simultaneous.

In one embodiment the selected rate of NCG relative to steam is between about 0.2 mol % and about 0.8 mol %.

In one embodiment the method further includes adjusting the amount of NCG in the steam chamber by selectively injecting NCG into the LD well to increase the amount of NCG or producing fluids from the LD well to reduce the amount of NCG.

In one embodiment, adjusting the amount of NCG in the steam chamber includes manipulating the solubility of the NCG or a particular NCG component in water and bitumen or heavy oil such that the produced fluids contain in solution the amount of NCG or NCG component desired to be removed (the solubility control).

In one embodiment the temperature and/or pressure is manipulated to provide solubility control.

In one embodiment NCG is co-injected via the injection well in the presence of steam, and NCG is intermittently injected or produced via the LD well for control of the rise of the steam zone, in conjunction with solubility control.

In one embodiment the NCG buffer zone extends between a hot zone and a cold zone within the reservoir.

In one embodiment the selected condition is a selected portion of the thickness of the reservoir. In one embodiment the selected portion is between about 50% and about 75% of the thickness of the reservoir.

In one embodiment the selected condition is a selected steam saturation level. In one embodiment the selected steam saturation is between about 70% and about 80%.

In one embodiment the selected condition is a period of time. In one embodiment, the time is between about six (6) months and about sixty (60) months from first steam.

In one embodiment, the pressure of the steam chamber is reduced in a stepwise manner.

In one embodiment the pressure of the steam chamber is reduced in a plurality of steps over a pressure reduction time. In one embodiment, the pressure reduction time is substantially six months or more.

In one embodiment, the low pressure zone or loss zone is selected from the group of a low pressure gas zone, a gas or water zone in fluid communication with a low pressure gas zone, and a thief zone.

In one embodiment the operation of the SAGD well pair is initiated by the injection of high steam pressure into the injection well and the production well to promote fluid communication between the injection well and the production well.

In one embodiment the operation of the LD well is initiated by cyclic steam stimulation.

In one embodiment the NCG is injected through the injection well. In one embodiment the NCG is injected through the LD well.

In one embodiment the method further includes monitoring the height of the steam chamber in the reservoir.

In one embodiment the low pressure zone or loss zone is a low pressure gas zone, the pressure of the low pressure gas zone between about 200 kPa and about 1000 kPa.

In one embodiment the NCG is natural gas, combustion flue gas, modified combustion flue gas, carbon dioxide, air, gas mixtures consisting predominantly of nitrogen, tracer gas, or mixtures thereof.

In one embodiment the low pressure gas zone, or other zone in communication with a low pressure zone, is at a pressure of between about 200 kPa and about 1000 kPa.

In one embodiment the NCG is complemented or replaced by a light solvent. In one embodiment the light solvent comprising propane, butane, butane isomers, pentane, pentane isomers, hexane, hexane isomers, heptane, heptane isomers, benzene, toluene.

In one embodiment, the method further includes injecting a combustion sustaining fluid, and igniting a mixture of the combustion sustaining fluid and the hydrocarbon within the reservoir to provide a late stage sweep.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a low pressure recovery process for acceleration of in-situ bitumen recovery.

The objective of the invention is to accelerate production and increase recovery of bitumen and/or heavy oil from reservoirs in contact with low pressure subterranean zones, due to factors such as regional geology, depleted gas caps or other thief zones, or lack of cap rock. The invention will hereinafter be referred to as the SAGD Triplet Process.

Figure 1:
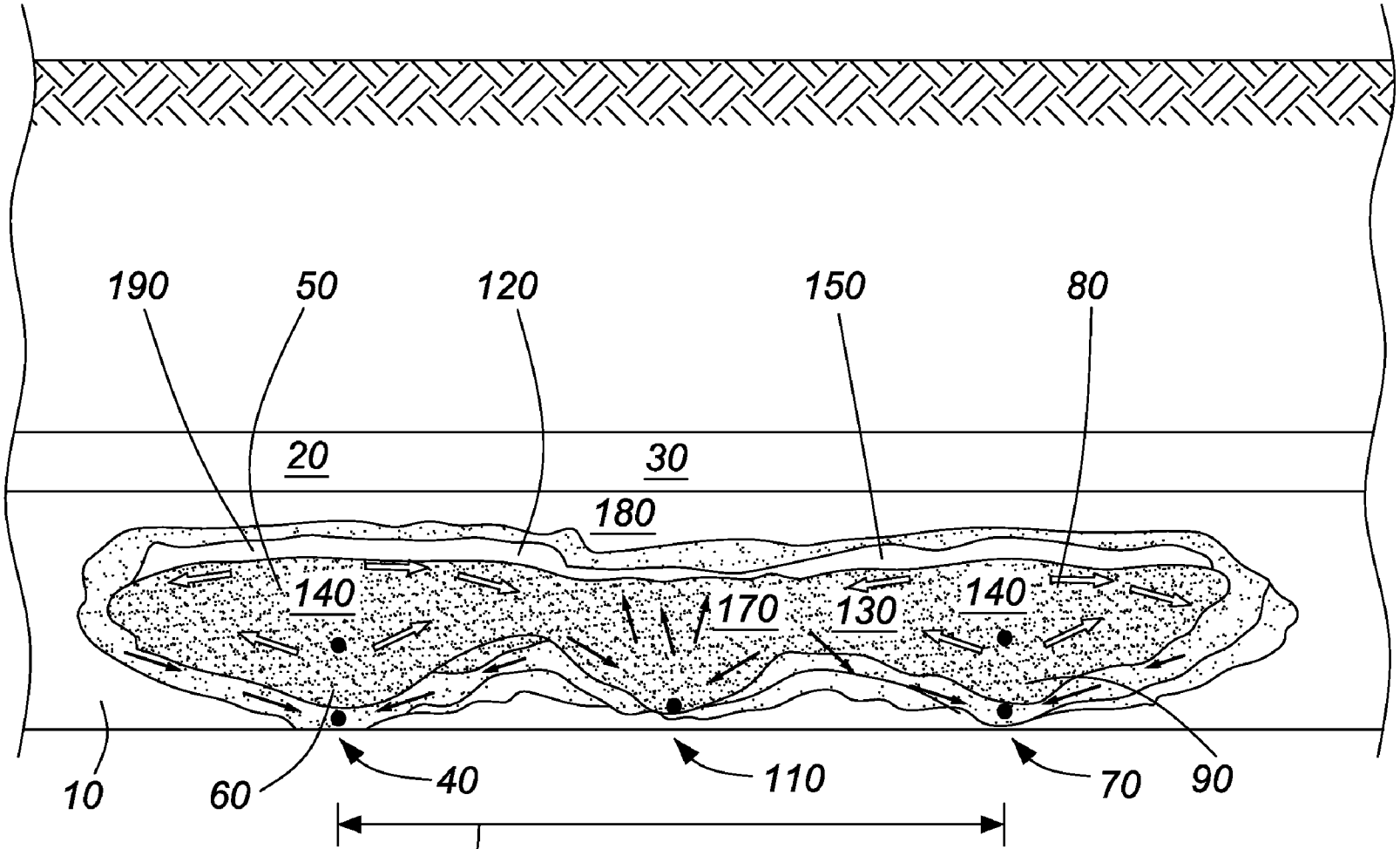
FIG. 1 is a schematic of an embodiment of the present invention.

Referring to FIG. 1, a reservoir of bitumen or heavy oil 10 sits below a low pressure zone or loss zone 20, for example a low pressure (gas) zone 30. A first SAGD well pair 40 having an injection well 50 and a production well 60, and a second SAGD well pair 70 having an injection well 80 and a production well 90 (together the first SAGD well pair 40 and the second SAGD well pair 70 forming adjacent SAGD well pairs 100) are drilled at close lateral spacing of 80 m or greater, as suitable for reservoir conditions.

A horizontal lateral drainage (LD) well 110 is provided between the adjacent SAGD well pairs 100. The LD well 110 may intermittently alternate between injection and production cycles. While the LD well 110 will inevitably produce some oil and water from the reservoir 10, the main purpose of the LD well 110 is to control the amount of gas 120 in a steam chamber 130 (formed when steam 140 is injected into the reservoir 10) at any given time, in concert with manipulation of gas solubility in water. This action promotes lateral communication between the adjacent SAGD well pairs 100, while causing the steam chamber 130 to rise at a reduced rate towards the low pressure gas zone 30. As the steam chamber 130 grows within the reservoir 10, a hot zone 170 expands while a cold zone 180 shrinks as the heat from the steam 140 is delivered to the reservoir 10.

Low volumes of non-condensable gas (NCG) 150 may be co-injected into the injection wells 50,80 and the LD well 110 at selected intervals to control or optimize the growth of the steam chamber 130. Preferably between about 0 mol % and about 0.8 mol % NCG 150 is intermittently introduced into the steam chamber 130. A NCG buffer zone 190 forms between the steam chamber 130 and the low pressure zone or loss zone 20. The NCG 150 will inhibit or limit the vertical rise rate of the steam chamber 130, allowing the LD well 110 to promote lateral communication and lessen the impact of the low pressure zone 30 above the reservoir of bitumen or heavy oil 10. Steam 140 is substantially continuously injected via the injection wells 50,80, and intermittently augmented by NCG 150. Steam 140 is intermittently injected via the LD well 110 and augmented by NCG 150. The LD well 110 may provide gas production and gas injection as required to control the amount of gas 120 in the steam chamber 130.

As used herein, gas 120 includes solution gas (for example methane, nitrogen etc.) reaction gas (for example H2S, CO2 etc.) and NCG 150 injected (for example natural gas, combustion flue gas, modified combustion flue gas such as oxygen removed by scavenging or otherwise, carbon dioxide, oxygen, air, gas mixtures comprising predominantly of nitrogen, mixes thereof, and other gases known to one skilled in the art).

Use of the LD well 110 for either injection or production is dictated by the nature of the reservoir 10 and selected by one skilled in the art of SAGD. While some of the background art may peripherally refer to continuous injection of gas or light hydrocarbons into a thief zone above or adjacent the bitumen or heavy oil to maintain or build pressure, the present invention requires controlled intermittent injection of NCG 150 or light hydrocarbons into the steam chamber 130. Continuous injection would be detrimental in the application of this invention. As one skilled in the art will recognize, larger amounts of NCG 150 injected into the steam chamber 130 affect the equilibrium of the steam in the steam chamber 130 and as little as 0.8 mol % NCG 150 in steam 140 have been predicted to at least partially collapse the steam chamber 130 under certain conditions.

The amount of NCG 150 and certain NCG components in the steam chamber 130 at any given time may be controlled.

It is known that gases that are normally insoluble in water/steam become soluble at high temperature and pressure. A method of controlling the presence of NCG 150 or individual NCG components, based on solubility control is provided, whereby solubility manipulation permits gas 120/NCG 150 removal via water production and/or oil production.

Figure 3:
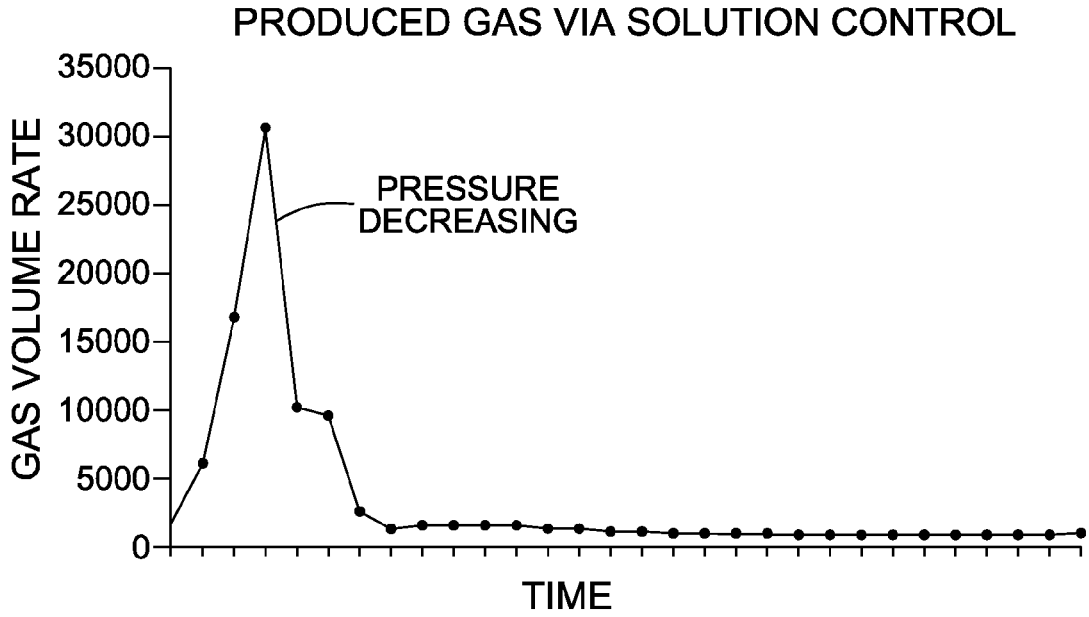
FIG. 3 is a graph of an example of produced gas via solubility control of an embodiment of the present invention.
Figure 4:
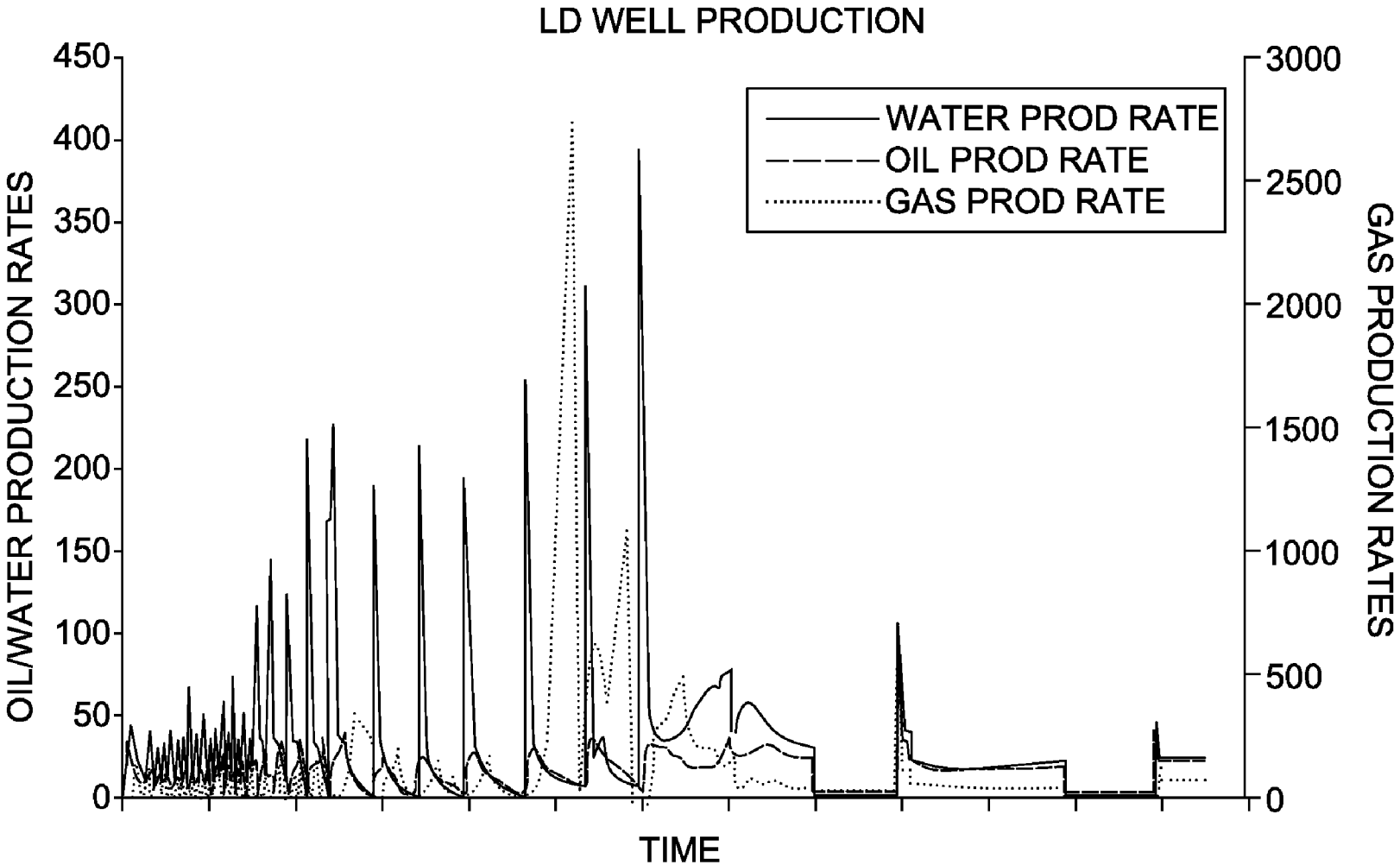
FIG. 4 is a graph of an example of LD well production of an embodiment of the present invention.

FIGS. 3 and 4 illustrate typical gas removal trends and rates by solubility control and LD well 110 control at various stages of the process. FIG. 4 also illustrates typical water and oil production trends and rates.

The operating pressure in the adjacent SAGD well pairs 100 and the LD well 110 is reduced as the steam chamber 130 rises to balance with the low initial reservoir pressure. In the case where the low pressure zone or loss zone 20 is a depleted gas cap, the operating pressure may be reduced to substantially balance with the pressure of the depleted gas cap. The process can operate at low pressures, for example about as low as 200 kPa, whereas the lowest steam pressure thus far utilized in the field is 800 kPa, and the Alberta Energy Resources Conservation Board has previously recognized that a lower limit of 600 kPa is feasible. The invention therefore may be applicable to reservoirs with very low gas pressures, where recovery has not heretofore been attempted.

Low Pressure SAGD

Pumps suitable for oil production at low pressure SAGD conditions are used. These pumps are landed at or close to horizontally in the production wells 60,90. This, in combination with the low net positive suction head allows for pump inlet pressures as low as 200 kPaa.

Non-Condensable Gas Injection/Co-Injection

Carefully managed intermittent NCG 150 co-injection is used to control steam chamber 130 rise rates, thereby reducing the impact of the low pressure zone 30 above the bitumen, such as those that have been pressure depleted by prior gas production. This encourages lateral growth of the steam chamber 130, improving sweep efficiency of the process.

NCG behaviour in SAGD is governed by the following principles:

First. NCG 150 (methane, flue gas, modified flue gas, and other gases) have relatively low densities and will migrate toward the top of the steam chamber 130, providing a buffer zone 160 between the steam chamber 130 and the overlying low pressure zone or loss zone 20, such as the low pressure zone 30. Heat loss and steam loss to the low pressure zone or loss zone 20 are also controlled or reduced.

Second. Injection of NCG 150 in SAGD will cause a portion of the steam 140 in the steam chamber 130 to condense, thereby releasing latent heat to the reservoir 10 and therefore reduces the quality of the steam 140 in the steam chamber 130. Small volumes of NCG 150 injected with steam 140 will result in a bitumen production increase due to the additional latent heat transfer. Over-injection of NCG 130 could cause instability, damage or collapse of the steam chamber 130, negatively impacting overall production and oil recovery. Thus, the injection of NCG 150 (whether alone or co-injected with steam) as well as the amount of NCG 150 present in the steam chamber 130 should be carefully and substantially continuously controlled during operations.

Figure 2:
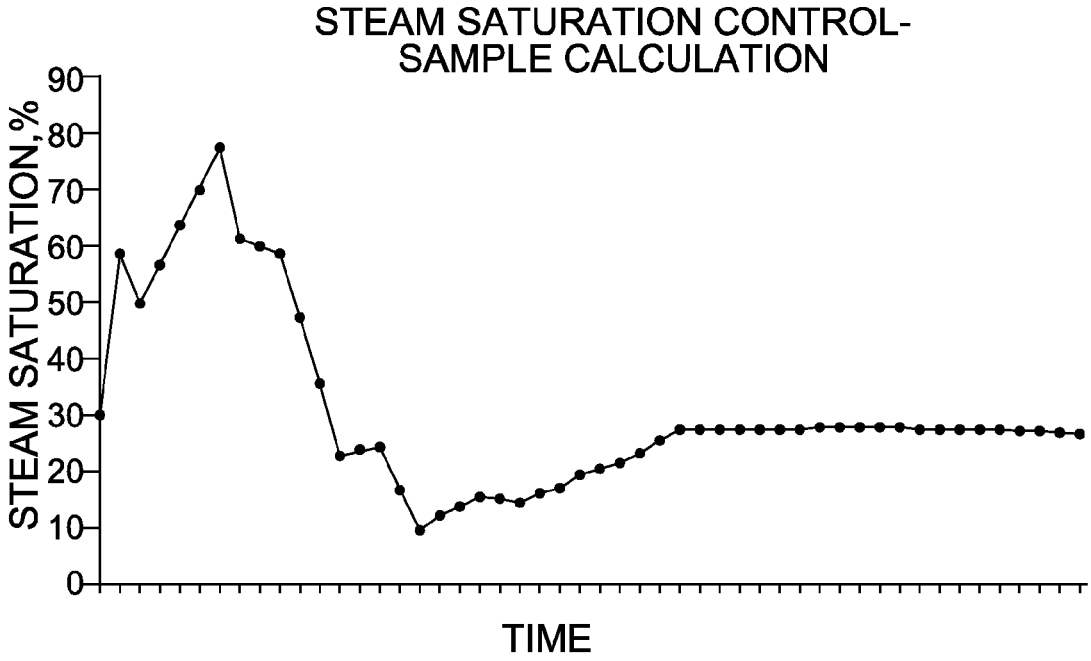
FIG. 2 is a graph of an example of steam saturation control of an embodiment of the present invention.

Third. At certain SAGD conditions, the injected NCG 150 has similar or greater solubility in water than in heavy oil or bitumen; therefore at least a portion of the co-injected NCG 150 or other gas is removed from the steam chamber 130 by solution in bitumen and produced water (for example, see FIGS. 3 and 4). A sample calculation for the control of steam saturation in the steam chamber 130 is illustrated in FIG. 2. In the initial or early stages of operation, the steam chamber 130 is created or expanded at high pressures (temperatures), for example about 3500 kPa steam at about 240° C. for about 25 m of pay (as would be known to one skilled in the art as a suitable pressure for the Athabasca Oil Sands in Alberta, Canada) or some pressure dictated by the reservoir properties.

In the early stages, there is little to substantially no accumulation of NCG 150 in the steam chamber 130 because substantially all of the gases that normally arise in SAGD (for example including reaction gas and solution gas and other gases) are produced due to their solubility in the oil or water.

At some selected condition, for example the peak of steam saturation (see FIG. 2), NCG 150 is co-injected with the steam 140 and the pressure is reduced. The pressure may be reduced gradually, for example through a number of steps down over a period of time. Gas 120 is produced more slowly, and intermittent NCG 150 injection or NCG production via the LD well 110 is used to control the NCG 150 in concert with solubility control of NCG 150 production.

In the later stages of operation, most production of the gas 120 takes place via the LD well 110. The steam saturation, as shown in FIG. 2, is kept substantially at a level that provides control of the time of steam breakthrough to the low pressure zone or loss zone 20 to improve cumulative recovery of the bitumen or heavy oil resource from the reservoir 10.

These principles allow for the development of NCG injection strategies to manage and optimize steam chamber growth.

Well Configuration and Operating Strategy

The adjacent SAGD well pairs 100 are started up at an operating pressure of approximately 3500 kPa (as above, for the reasons above), or a pressure defined by the reservoir characteristics. This, first steam, pressure is chosen to be within a safe operating range, and will provide higher initial production rates and faster warm up. This higher temperature start up contributes to the commercial success of the process by accelerating production and improving lateral sweep and bitumen recovery.

Once the steam chamber 130 has formed to a selected condition (for example to a selected height in the reservoir, or after a selected period of time, or some other condition known to one skilled in the art), steam pressures are progressively lowered to control expansion of the steam chamber 130, and NCG 150 is injected at low rates and in a controlled manner to control and optimize the rise rate of the steam chamber 130 and prevent negative impacts of breakthrough or steam loss to the low pressure zone or loss zone 20, and to encourage lateral growth of the steam chamber 130 by means of manipulation production of gas 120 at the LD well 110.

High Temperature Oxidation/Combustion

In an alternative embodiment, air or other combustion sustaining fluid may be injected rather than the NCG 150, such that, with ignition, combustion occurs within the reservoir 10 and provide a late stage sweep. This would typically be a wind down strategy after the horizontal sweep.

Further Benefits of the Invention

The invention may be utilized to reduce greenhouse gas emissions in at least two ways:

First, the low pressure operation requires less energy to convert a cubic metre of water to steam than does operation of SAGD at higher steam pressure; in the SAGD Triplet Process, it is possible to operate at temperatures of 150° C. (300° F.) or less, whereas typical SAGD operations to date have utilized temperatures between 165° C. (330° F.) and 270° C. (520° F.). Accordingly, less fuel, which is typically natural gas for combustion, is required to convert boiler feed water to steam, and the resulting efficiency reduces the amount of carbon dioxide that is emitted to the atmosphere in the generation of steam for SAGD.

As one skilled in the art recognizes, typical SAGD operations (and the present invention) utilize substantially saturated steam, and thus generally a reference to a steam pressure is also a reference to the corresponding saturated steam temperature and vice versa. However, wet steam and/or superheated steam may alternatively be used.

Second, the NCG 150 utilized for co-injection with steam 140 may be chosen to be flue gas from the steam generation process. The flue gas may contain approximately 11% by volume of carbon dioxide. Sound theoretical calculations predict that only a relatively small fraction of this carbon dioxide will be produced back with oil and water in the SAGD Triplet Process, and thus geological sequestration of the injected carbon dioxide is achieved. While the amount of this geological sequestration is relatively small compared to that of deeper, high pressure reservoirs, it does measurably reduce the carbon dioxide footprint of the recovery of bitumen by other SAGD processes. The details will be dependent on the steam pressure chosen in a particular application of the invention, but may be readily determined by one skilled in the art.

Applications

The present invention applies to any heavy oil or bitumen deposit where the initial reservoir pressure is low, due to regional geological factors, or in which the overlying zone is at low pressure due to gas production or to any other cause. The pattern of the well arrangement shown may be repeated in parallel to the wells shown, and the following are the aspects of the invention:

The adjacent SAGD well pairs 100 are drilled and completed with substantially parallel trajectories, where the injection well 50,80 lies a few meters above the corresponding production well 60,90;

Substantially parallel to the adjacent SAGD well pairs 100, at a distance to be selected by one skilled in the art considering reservoir characteristics, but usually 30 metres or greater, the LD well 110 of generally the same length is drilled and completed.

This arrangement may be repeated at will. While FIG. 1 shows an embodiment having adjacent SAGD well pairs 100 with an intermediate LD well 100, one skilled in the art recognizes that the invention may be practiced in other configurations including a single SAGD well pair with a LD well (such as the first SAGD well pair 40 and the LD well 110) or multiple LD wells may be provided within the steam chamber 130.

The production wells 60,90 and the LD well 110 are equipped with pumps suitable for oil or water production at low pressure and temperature of steam, for example progressing cavity pumps, such as metal-metal progressing cavity pumps. The equipment is suitable for production of oil and water at steam temperatures and pressures well below those of normal SAGD operations in Alberta.

The injection wells 50,80 and LD well 110 are fitted with equipment that permits the intermittent injection and production of NCG 150, including but not limited to natural gas, flue gases from steam generation, nitrogen or gases where the nitrogen content predominates, or tracer gases that may be used to study the fluid behaviour of the reservoir.

The injection rates of NCG are intermittent rather than continuous, are selectably varied from time to time as desired from the data pertaining to the project operations.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method of producing hydrocarbons from a subterranean reservoir comprising:

a. providing a SAGD well pair, including an injection well and a production well within the reservoir containing the hydrocarbons and a low pressure zone or loss zone at least partially overlaying the hydrocarbons, the low pressure zone or loss zone having a pressure of less than 1000 kPa;

b. providing a lateral drainage (LD) well, laterally offset from the SAGD well pair within the reservoir;

c. initiating operation of the SAGD well pair and the LD well to create or promote a common steam chamber within the reservoir between the hydrocarbons and the low pressure zone or loss zone and establish fluid communication among the injection well, production well, and the LD well;

d. injecting steam into the steam chamber via at least one of the injection well and the LD well and withdrawing produced fluids from the steam chamber via at least one of the production well and the LD well to grow the steam chamber vertically between the hydrocarbons and the low pressure zone or loss zone until to minimize or prevent fluid loss into the low pressure or loss zone; and e. selectively co-injecting non-condensable gas (NCG) with the steam into the steam chamber at a selected rate and reducing the pressure of the steam chamber to control and optimize rise rate of the steam chamber by manipulating levels of the NCG in the steam chamber to promote an NCG buffer zone between the steam chamber and the low pressure zone or loss zone while encouraging lateral growth of the steam chamber while keeping saturation and condensation of the steam in the steam chamber at a level that provides control over breakthrough of the steam through the NCG buffer zone to the low pressure zone or loss zone; and f. operating the well pair and the LD well under conditions of a pressure in the steam chamber that is initially and briefly high to establish the steam chamber, but thereafter may be reduced to as low as 200 kPa to recover the hydrocarbons from the reservoir via the production well.

2. The method of claim 1, wherein selectively injecting NCG into the steam chamber at a low rate and reducing the pressure of the steam chamber is substantially simultaneous.

3. The method of claim 1 wherein the selected rate of NCG relative to steam is between about 0.2 mol % and about 0.8 mol %.

4. The method of claim 1, further comprising adjusting the amount of NCG in the steam chamber by selectively injecting NCG into at least one of the injector well and the LD well to increase the amount of NCG or producing fluids from at least one of the production well and the LD well to reduce the amount of NCG.

5. The method of claim 1, wherein the NCG buffer zone extends between a hot zone and a cold zone within the reservoir.

6. The method of claim 1, wherein the operation of the SAGD well pair is initiated by the injection of high steam pressure into the injection well and the production well to promote fluid communication between the injection well and the production well.

7. The method of claim 1, wherein the operation of the LD well is initiated by cycling between injection and production cycles.

8. The method of claim 1, wherein the NCG is injected through the injection well.

9. The method of claim 1, wherein the NCG is injected through the LD well.

10. The method of claim 1, further comprising monitoring the height of the steam chamber in the reservoir.

11. The method of claim 1, the NCG comprising natural gas, combustion flue gas, modified combustion flue gas, carbon dioxide, air, gas mixtures consisting predominantly of nitrogen, tracer gas, or mixtures thereof.

12. The method in claim 1 where the low pressure gas zone, or other zone in communication with a low pressure zone, is at a pressure of between 200 kPa and 1000 kPa.

13. The method of claim 1, wherein adjusting the amount of NCG in the steam chamber comprising manipulating the solubility of the NCG or a particular NCG component in water and bitumen or heavy oil such that the produced fluids contain in solution the amount of NCG or NCG component desired to be removed (the solubility control).

14. The method of claim 13, wherein the temperature and/or pressure is manipulated to provide the solubility control.

15. The method of claim 14, wherein NCG is co-injected via the injection well in the presence of steam, and NCG is intermittently injected or produced via the LD well for control of the rise of the steam zone, in conjunction with the solubility control.

16. The method of claim 1, wherein the selected condition is a selected portion of the thickness of the reservoir.

17. The method of claim 16, wherein the selected portion is between about 50% and about 75% of the thickness of the reservoir.

18. The method of claim 1, wherein the selected condition is a selected steam saturation level.

19. The method of claim 18, wherein the selected steam saturation is between about 70% and about 80%.

20. The method of claim 1, wherein the selected condition is a period of time.

21. The method of claim 20, wherein the period of time is between about six months and about sixty months from first steam.

22. The method of claim 1, wherein the pressure of the steam chamber is reduced in a stepwise manner.

23. The method of claim 22, wherein the pressure of the steam chamber is reduced in a plurality of steps over a pressure reduction time.

24. The method of claim 23, wherein the pressure reduction time is greater than about six months.

25. The method of claim 1, the low pressure zone or loss zone selected from the group of a low pressure gas zone, a gas or water zone in fluid communication with a low pressure gas zone, and a thief zone.

26. The method of claim 25, wherein the low pressure zone or loss zone is a low pressure gas zone, the pressure of the low pressure gas zone between 200 kPa and 1000 kPa.

* * * * *